US005111759A

United States Patent [19]

Hiramatsu et al.

[11] Patent Number: 5,111,759

[45] Date of Patent: May 12, 1992

[54] INCONSTANT-THICKNESS WORKPIECE FEEDING APPARATUS

[75] Inventors: Toru Hiramatsu; Akiyoshi Urano, both of Chofu, Japan

[73] Assignee: Juki Corporation, Tokyo, Japan

[21] Appl. No.: 629,405

[22] Filed: Dec. 18, 1990

[30] Foreign Application Priority Data

Dec. 19, 1989 [JP] Japan ..... 1-328725
May 22, 1990 [JP] Japan ..... 2-131613

[51] Int. Cl.[5] ..... D05B 27/10; B65H 3/06
[52] U.S. Cl. ..... 112/322; 271/23
[58] Field of Search ..... 112/303, 314, 318, 322, 112/311, 319, 121.29, 121.11, 113; 271/16, 21, 23; 19/108, 112

[56] References Cited

U.S. PATENT DOCUMENTS

| | | | |
|---|---|---|---|
| 1,622,518 | 3/1927 | Johnson | 271/23 |
| 1,936,548 | 11/1933 | Brooks | 19/108 X |
| 2,533,932 | 12/1950 | Hayek | 271/23 X |
| 2,817,518 | 12/1957 | Anness | 271/23 |
| 3,466,030 | 9/1969 | Swanson | 271/23 X |
| 4,093,207 | 6/1978 | Greenwell et al. | 271/23 X |
| 4,157,823 | 6/1979 | Morton | 271/10 |

FOREIGN PATENT DOCUMENTS

| | | | |
|---|---|---|---|
| 1561951 | 4/1969 | France . | |
| 54-22673 | 2/1979 | Japan . | |
| 54-22674 | 2/1979 | Japan . | |
| 54-22675 | 2/1979 | Japan . | |
| 56-43138 | 4/1981 | Japan . | |
| 63-247237 | 10/1988 | Japan | 271/21 |
| 1221196 | 9/1989 | Japan . | |
| 1286064 | 8/1972 | United Kingdom . | |

OTHER PUBLICATIONS

IBM Technical Disclosure Bulletin, vol. 18, No. 9, Feb. 1976, pp. 2923-2924, Page Turner.

*Primary Examiner*—Werner H. Schroeder
*Assistant Examiner*—Paul C. Lewis
*Attorney, Agent, or Firm*—Morgan & Finnegan

[57] ABSTRACT

An apparatus for picking up and feeding, one by one, workpieces which are stacked in a guide, such as shirt cuffs or the like having an inconsistent thickness. A pair of delivery rollers is rotated so as to slacken the lowermost workpiece so that the latter is readily drawn from the guide by a pickup means for supply to an automatic sewing station.

6 Claims, 11 Drawing Sheets 72
13
65
66
3'
67
73
75
76
77
72a
70
74a
74
11
8
6'
8'
7'
5'
7
64
5
6
61a
62
63
60
20
1
61

INCONSTANT-THICKNESS WORKPIECE FEEDING APPARATUS

BACKGROUND OF THE INVENTION

This invention relates to a workpiece feeding apparatus and more particularly to an "inconstant-thickness" workpiece feeding apparatus for loading workpieces which have thicknesses which may vary.

A conventional inconstant-thickness workpiece feeding apparatus, as shown in FIG. 9, has been previously adapted to stack a plurality of workpieces such as shirt cuffs of various thicknesses whose hems or margins are seamed and then to pick up the workpieces one by one, therby being able to provide a continuous supply. In general, a box-shaped stacker 50 is adapted to receive therein a plurality of identical shirt cuffs 100 in a stack oriented in the same direction. The stacker 50 as well as the cuffs are raised by an elevating means (not shown) until the uppermost cuff reaches a predetermined elevation where it is then delivered to a well-known pickup unit 51 for use with a vacuum chuck or a hook. The pickup unit is then moved to feed the cuff to a next sewing station, such as a station including a buttonholing machine and a button sewing machine.

However, disadvantages derive from such conventional inconstant-thickness workpiece feeding apparatuses. For example, as shown in FIG. 10, cuffs 100 are generally formed in such a manner that a front fabric 102 and a back fabric 103 are overlapped, a lining strip is interposed therebetween and a fold is made along the three sides of the fabrics, thereby defining a hem 104. This will render folded portions 100*a*, 100*b*, and 100*c* thicker than the central portion.

Consequently, when a plurality of the identical cuffs are received in a stack oriented in the same direction in the stacker 50, the stack of cuffs sags on the side which does not have the hem so that the appearance of the stack is basically rectangular but with a curved portion. More specifically, the top of the stack provides a three dimensional curved surface with points a, b, c, and d in order of height as shown in FIG. 9. The greater the number of cuffs are, the more conspicuous this phenomenon becomes.

For this reason, it is very difficult for the pickup unit 51 to pick up the uppermost cuff since the latter is neither planar nor flat and its configuration with respect to the pickup unit varies and may not be stable depending upon material used in making the cuffs and the number of the cuffs in the stacker. This situation can make the apparatus function improperly.

Moreover, a conventional stacker 50 designed to accommodate a large plurality of the stacked cuffs would require massive and complicated equipment to control its elevation and height. This would also incur great expense.

It is therefore an object of the invention to provide an inconstant-thickness workpiece feeding apparatus capable of ensuring a supply of workpieces in a stable manner.

It is a further object of the invention to provide an inconstant-thickness workpiece feeding apparatus which is compact so as to make the apparatus inexpensive to manufacture.

SUMMARY OF THE INVENTION

These and other objects of the invention are met by providing an instant-thickness workpiece feeding apparatus which draws the lowermost workpiece held flat in a predetermined position at all times, regardless of the shape of the uppermost workpiece or the number of workpieces.

In preferred embodiments, the invention provides at least one delivery roller which is adapted to abut against the bottom surface of the lowermost workpiece in the stack and is rotated in one direction to downwardly draw the lowermost workpiece by friction therewith to form a slack longitudinally of the workpiece. A pickup means projects into the slack and is lowered to downwardly pull the lowermost workpiece from the stack.

Preferably, two delivery rollers may be provided, along with a mechanism to vary the distance therebetween, so as to allow the central portion of the workpiece to be clamped longitudinally.

The delivery roller may be preferably provided on its outer periphery with a plurality of needle-shaped projections each of which includes a forward end that is bent in the direction which the roller is rotated. The roller is preferably rotated at an angle not exceeding 90°.

With the arrangement as aforementioned, the lowermost workpiece in the stack is caused to slacken by rotation of the delivery roller such that the slack is downwardly pulled by the pickup unit to facilitate removal of the workpieces one by one, The lowermost workpiece in the stack is held flat in position at all times, thus allowing the workpieces to be supplied in a stable manner.

The invention, in preferred embodiments, will moreover not require elevating means for lifting and lowering the massive and heavy stacker loaded with stacked workpieces as in conventional inconstant workpiece stacking apparatuses which are designed to take out the uppermost workpiece in a stack. In addition, means for controlling the height of the stacker are generally not required, thereby simplifying the arrangement.

Preferably, the distance between the two delivery rollers may be varied not only to form a large degree of slack about the center of the workpiece with a slight degree of rotation of the delivery rollers but also to adjust the distance between the rollers according to the stiffness of the workpiece.

Additionally, the delivery roller may be provided on its outer periphery with a plurality of needle-shape projections. Each projection may include a forward end that is bent in the direction in which the roller is rotated to allow these needle-shape projections to increase friction with the inconstant-thickness workpiece when the delivery roller is rotated, thereby avoiding slippage between the roller and the workpiece and withdrawing the latter without any resistance.

Further, rotating the roller at an angle not exceeding 90° ensures that the slack of the workpiece being pulled downwardly out of the stack will not cover the lower half of the roller or be penetrated with the needle-shape projections, thus avoiding interference with the removal of the workpiece.

BRIEF DESCRIPTION OF THE DRAWINGS

The invention will be described in greater detail below by way of reference to the accompanying drawings, in which.

DETAILED DESCRIPTION OF THE DRAWINGS

Figure 1:
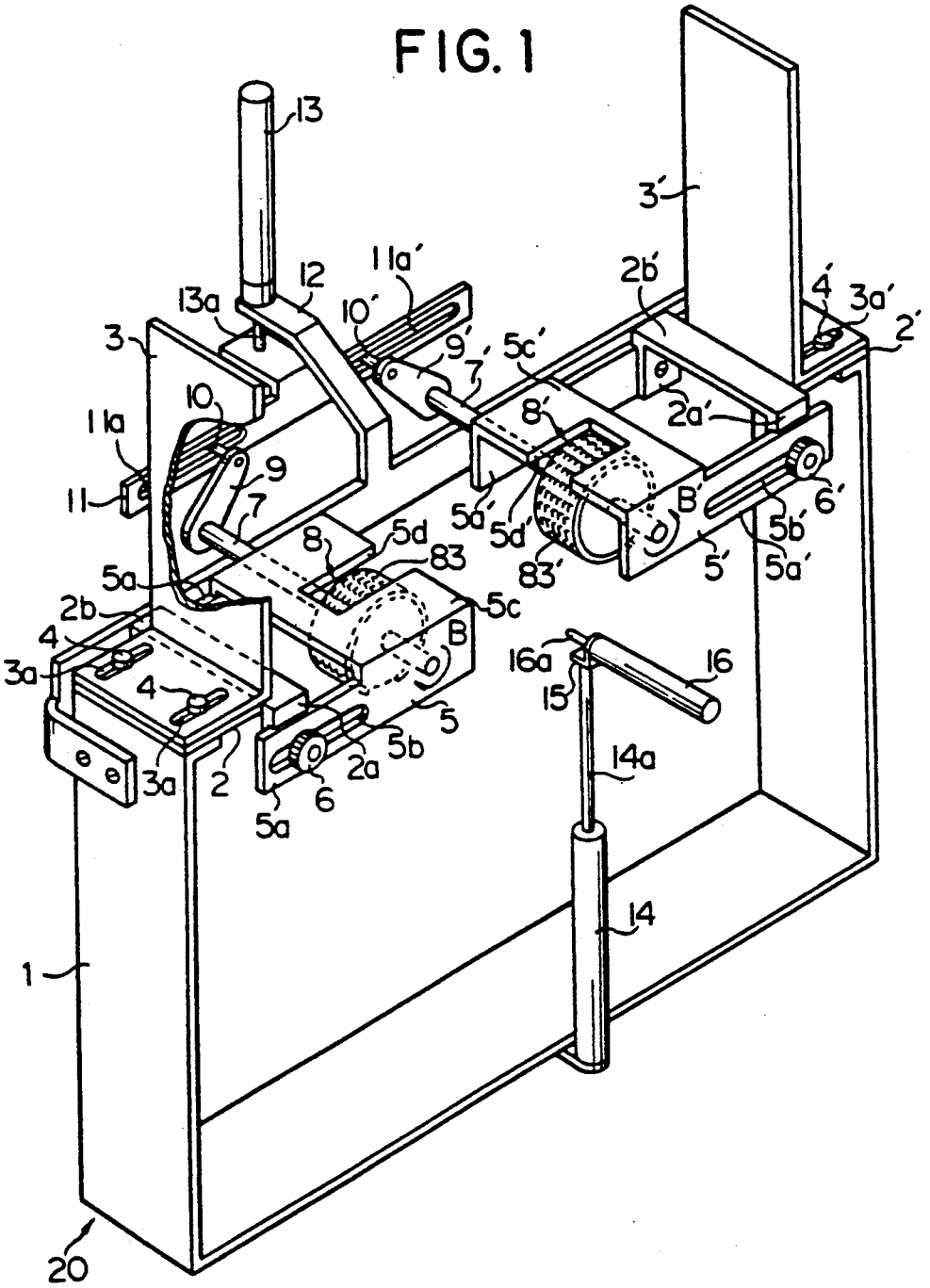
FIG. 1 is a perspective view showing an inconstant-thickness workpiece feeding apparatus according to one embodiment of the invention.
Figure 2:
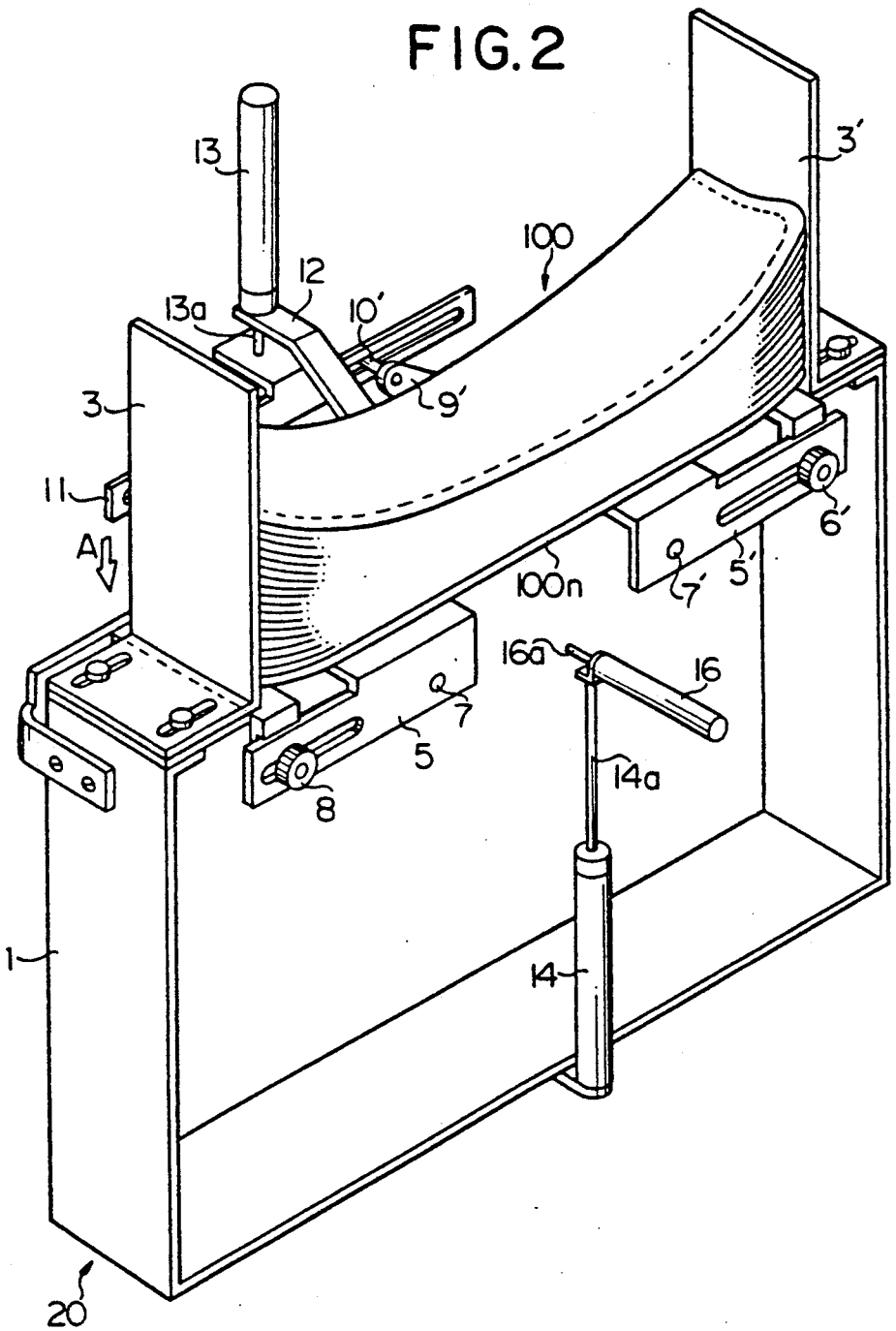
FIG. 2 is a perspective view of the embodiment of FIG. 1 but showing the manner in which shirt cuffs are stacked.

FIG. 1 is a perspective view showing one embodiment of the invention partially broken away, and FIG. 2 is a perspective view showing the manner in which shirt cuffs are stacked.

For convenience of illustration, reference characters of oppositely disposed but similarly functioning parts are the same with the "prime" sign ' affixed.

Referring to FIG. 1, a pair of guide plates 3, 3' is mounted by a pair of brackets 2, 2' and set screws 4 on the top of a frame member 1 as to adjust the distance between the brackets according to the dimension of cuffs to be stacked. A pair of U-shaped roller mounting plates 5, 5' are mounted on bent portions 2*a*, 2*a*' of the brackets 2, 2' so as to adjust the distance between the plates by means of slots 5*b*, 5*b*' formed in upright portions 5*a*, 5*a*' and set screws 6, 6'.

A cuff rack is defined by horizontals 2*b*, 2*b*' of the brackets 2, 2' and another pair of horizontals 5*c*, 5*c*' of the roller mounting plates 5, 5' Two roller shafts 7, 7' are rotatably journaled between two pairs of verticals 5*a*, 5*a*, and 5*a*', 5*a*' of the roller mounting plates 5, 5', respectively and include a pair of delivery rollers 8, 8' integral therewith. The delivery rollers 8, 8' are adapted to slightly expose arcs thereof to recesses 5*d*, 5*d*' formed in the horizontals 5*c*, 5*c*'. The projected arcs are positioned facing each other with the substantially central portion of the lowermost cuff.

The roller shafts 7, 7' carry arms 9, 9' each of whose one end is rigidly mounted on the end of its respective shaft. Connecting pins 10, 10' are attached to the other ends of the arms' 9, 9' to extend in directions opposite to the directions of the roller shafts 7, 7' Connecting pins 10, 10' are loosely inserted in slots 11*a*, 11*a*' formed in drive plate 11. A drive cylinder 13 is fixed to a cylinder mounting plate 12 integral with the frame member 1. One end of a piston rod 13*a* is affixed to the drive plate 11. The drive plate 11 is downwardly driven by the drive cylinder 13 to drive the connecting pins 10, 10' downwardly so that the delivery rollers 8, 8' are allowed by the arms 9, 9' and the roller shaft to rotate in directions of arrows B, B' at an angle not exceeding 90°.

In this instance, as seen from FIG. 1, a pair of the delivery rollers 8, 8' are adapted to rotate in the opposite directions.

Another drive cylinder 14 is secured centrally and downwardly of the frame member 1 and is provided with a piston rod 14*a* one end of which is connected with another drive cylinder 16 by an L-shaped angle fitting 15. A piston rod 16*a* of the drive cylinder 16 extends downwardly between the delivery rollers 8, 8'. A pickup unit is thus defined by the aforementioned parts.

Figure 3:
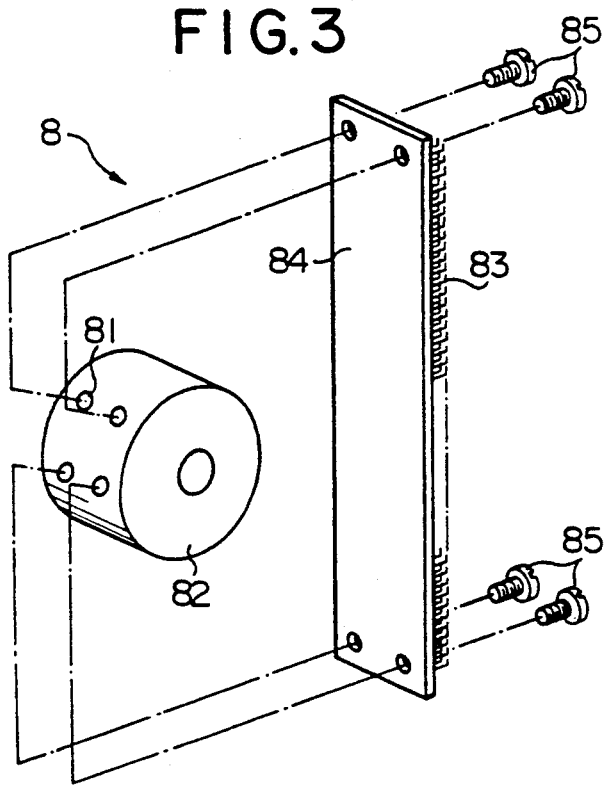
FIG. 3 is an exploded perspective view showing an arrangement of a delivery roller.

The details of the delivery roller 8 will be apparent from the following description in conjunction with FIG. 3.

The delivery roller 8 is composed of a roller member 82 with a plurality of tapped holes 81. In addition, elastic plate 84 (such as a rubber plate or the like) is formed on its outer periphery with a plurality of an angled needle-shape projections 83 and is fixed to the roller member. The elastic plate 84 is mounted by set screws 85 on the roller member in such a manner that an angled portion each of the projections is oriented to the direction where the delivery roller 8 is rotated. Delivery roller 8' is the same as the delivery roller 8.

Figure 4:
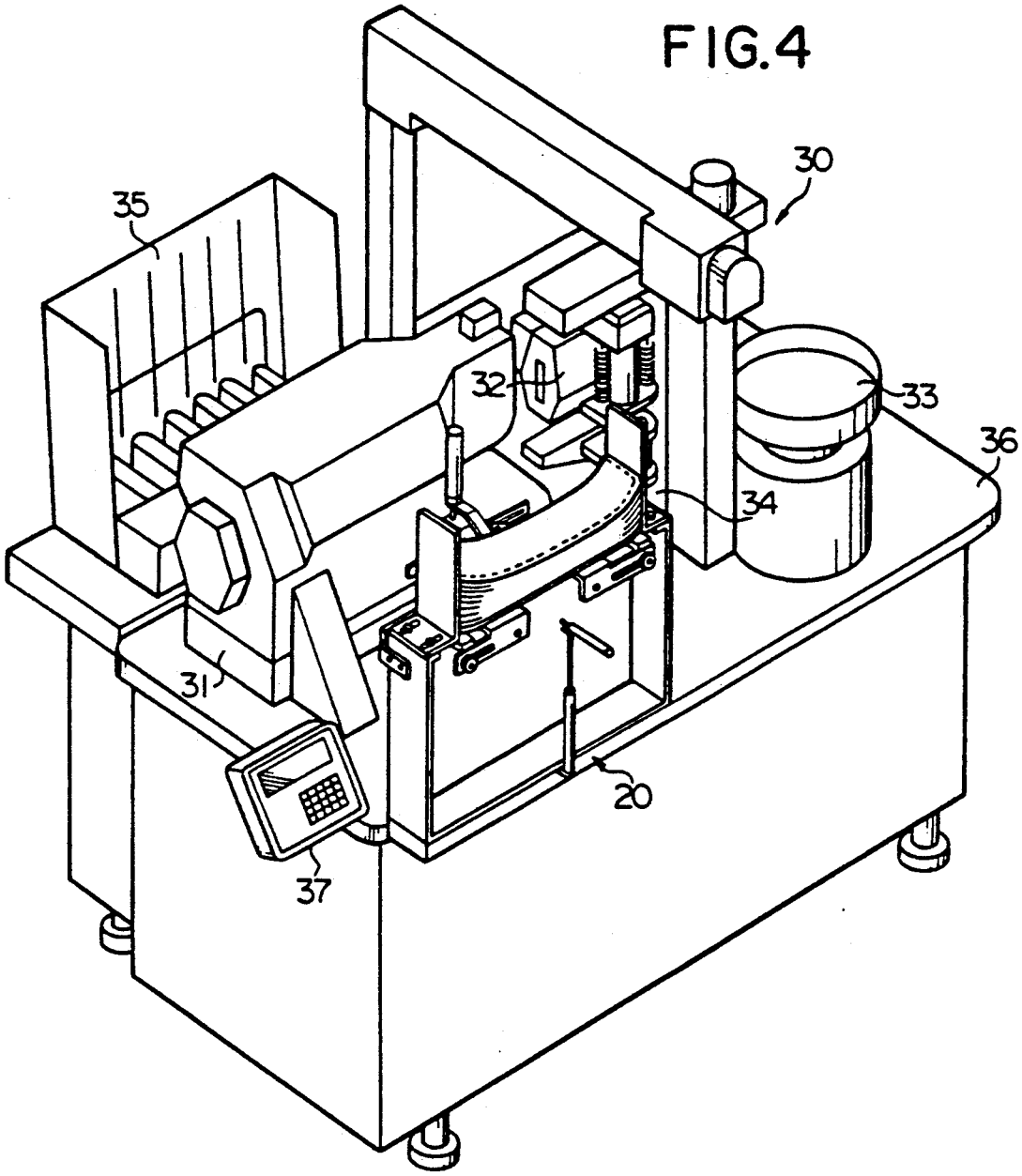
FIG. 4 is a perspective view showing an automatic sewing machine which includes the inconstant-thickness workpiece feeding apparatus according to the invention.

For example, in FIG. 4, an inconstant-thickness workpiece feeding apparatus 20, arranged as aforementioned, is carried on a work table 36 together with a bottonholing machine 31, a button sewing machine 32, a button feeder 33, a cuff conveyor 34, and a housing 35 to form an automatic sewing machine 30 such that the respective sewing operations may be automatically performed by actuation of a control panel 37.

In operation, the distance between the guide plates 3, 3' is adjusted by loosening the set screws 4, 4' so as to accommodate the length of the cuff to be sewed while the distance between the delivery rollers 8, 8' is adjusted by loosening set screws 6, 6' so as to move the roller mounting plates 5, 5' to accommodate the stiffness of the cuff. The cuffs are then stacked between the guide plates 3, 3' to obtain the condition as shown in FIG. 2.

Under such condition, the lowermost cuff 100*n* is caused to have its bottom surface abutted against the needle shape projections 83, 83' of the delivery rollers 8, 8' whereas the piston rods 13*a*, 16*a* of the drive cylinders 13, 16 are telescoped or retracted, and piston rod 14*a* of the drive cylinder 14 is projected.

Thereafter, the control panel 37 shown in FIG. 4 is actuated to start the apparatus, whereby drive cylinder 13 is supplied with air to lower the piston rod 13*a* and drive plate 11 which is attached thereto in the direction of an arrow A shown in FIG. 2.

Upon downward movement of drive plate 11, the connecting pins 10, 10' are also lowered by means of slots 11*a*, 11*a*' through which the pins pass such that arms 9, 9' and the roller shafts 7, rotate delivery rollers 8, 8' in the direction of the respective arrows B, B' of FIG. 1 through a predetermined angle that preferably does not exceed 90°.

Figure 5:
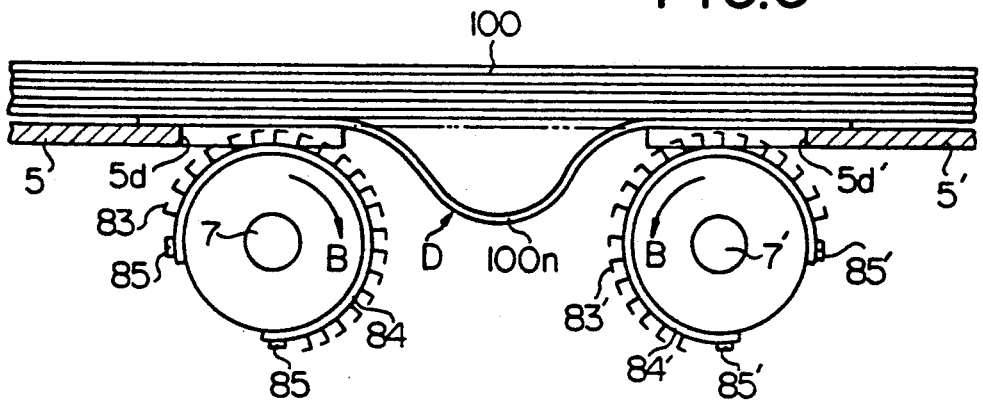
FIG. 5 is a representation showing the relationship between the delivery rollers and the inconstant-thickness workpieces in a stack.
Figure 6:
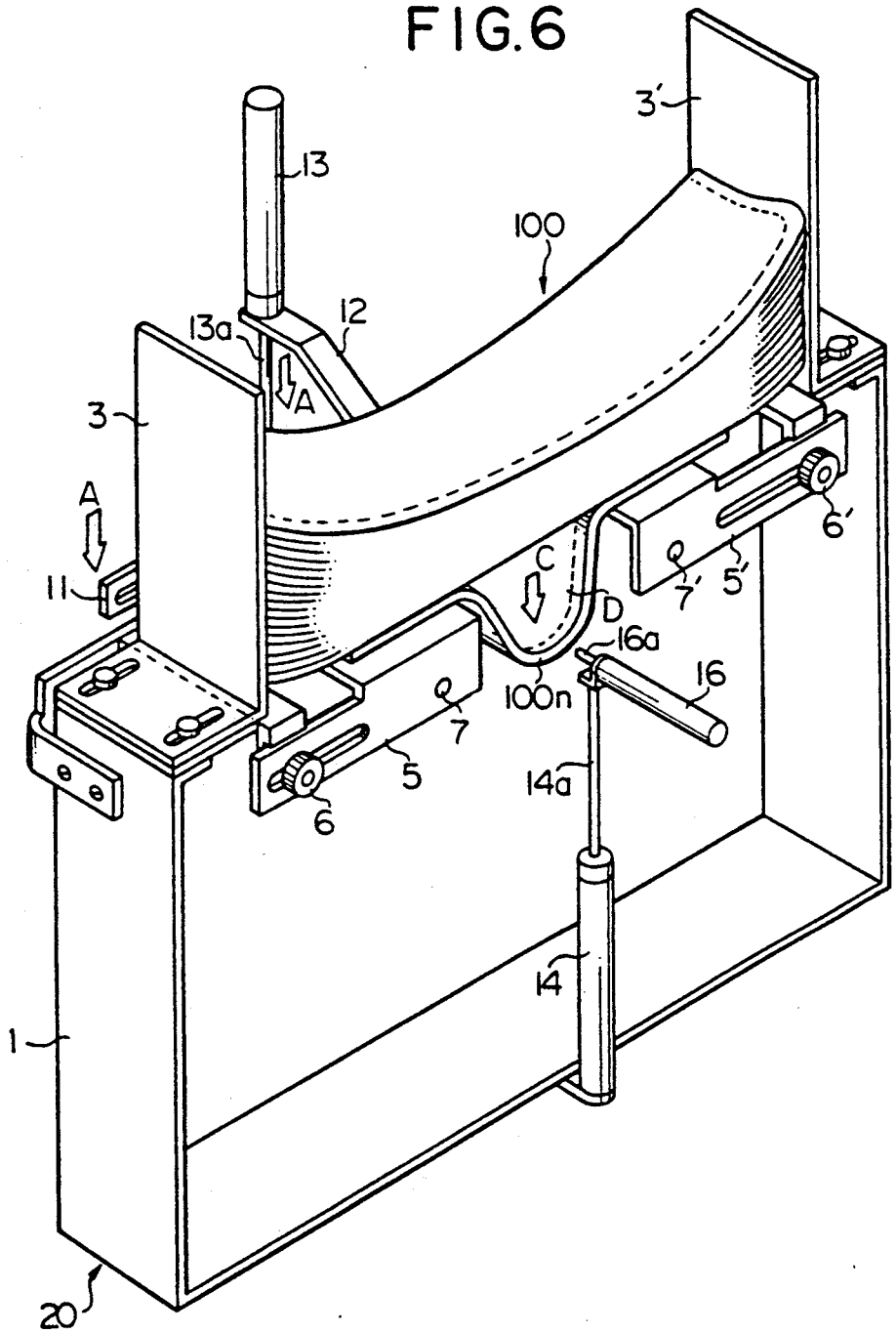
FIGS. 6, 7 and 8 are perspective views illustrating modes of the instant apparatus in an operative condition.

This will allow the two sets of the needle-shape projections 83, 83' to pull the lowermost cuff down to move from a position shown by a dot-dash line to a position shown by a solid line to form a slack D at the center of the cuff or workpiece (FIGS. 5 and 6). It is noted that the delivery rollers 8, 8' are rotated through an angle of less than 90° so that the pulled cuff 100*n* is prevented from extending over and wrapping around the rollers past the point where the needle-shaped projections are circumferentially facing directly downward. This is to render the cuff separable from the projections.

Figure 7:
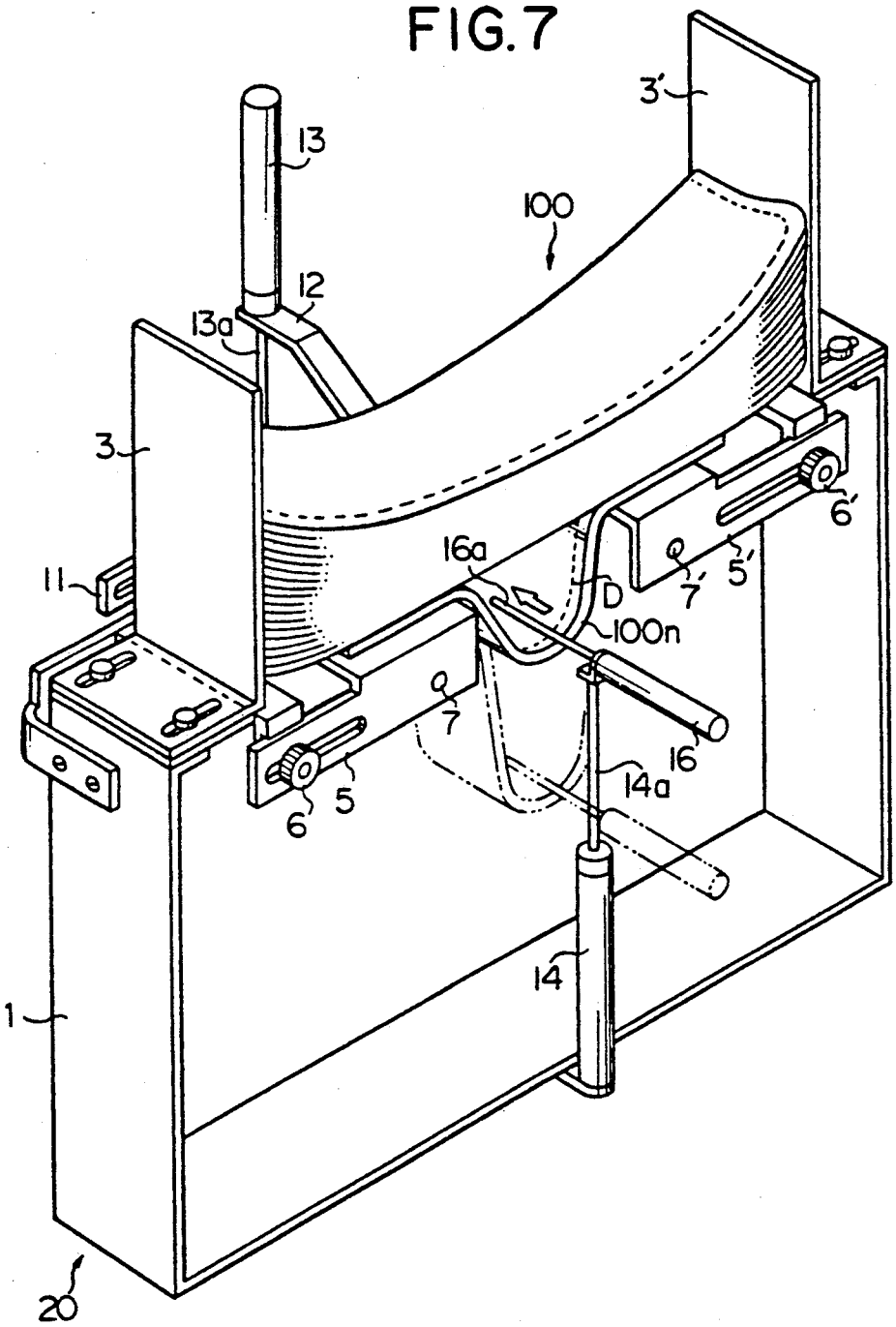
Figure 8:
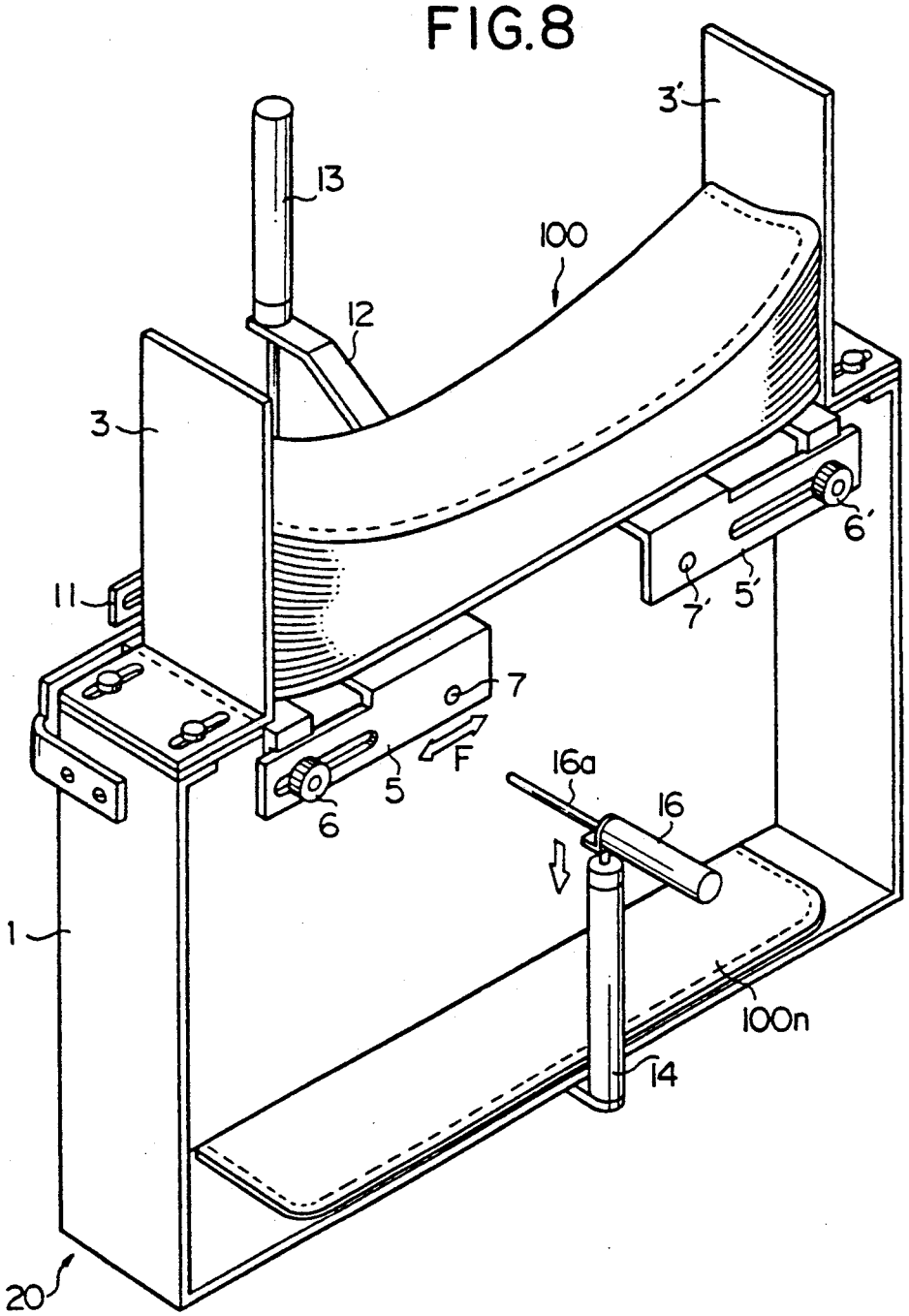
Figure 9:
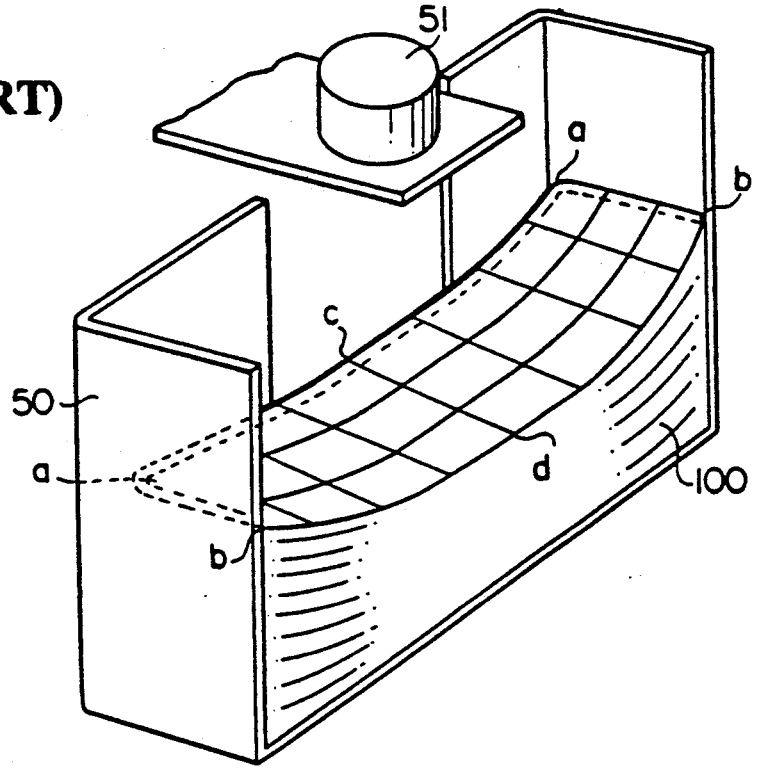
FIG.9 (PRIOR ART)
FIG. 9 is a perspective view of a substantial portion of a conventional workpiece feeding apparatus.
Figure 10:
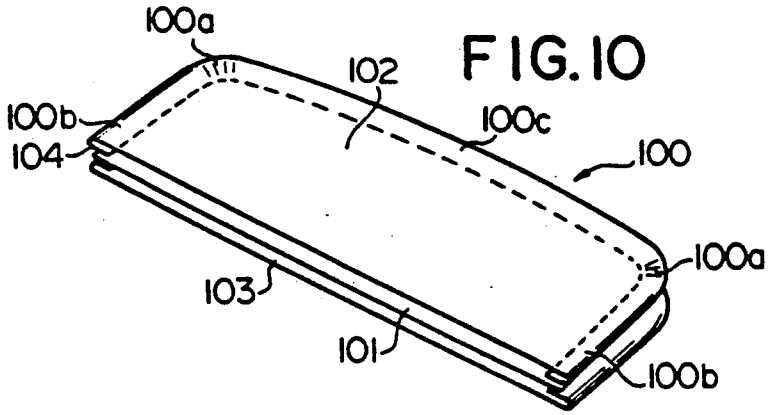
FIG. 10 is a perspective view of one form of inconstant-thickness workpiece.

When air is fed to the drive cylinder 16 to allow the piston rod 16*a* to extend to the slack D shown by the solid line of FIG. 7, the piston rod 14*a* of the drive cylinder 14 is lowered. In conjunction with the downward movement of piston rod 14*a*, the other piston rod 16*a*, also moves downwardly to a position shown by the dot-dash line. The cuff 100*n* is pulled at its central portion out and thus falls down to the bottom of the frame member, as shown in FIG. 8. Upon completion of the withdrawal of the cuff, the drive cylinders 13, 14 and 16 assume their respective positions as shown in FIG. 2.

It should be noted that the cuff is not subjected to resistance even if it is pulled out by a slidable engagement with the needle-shaped projections 83, 83'.

The cuffs which have fallen down in this manner may then be fed one by one by a cuff conveyor 34 as shown in FIG. 4, to a sewing station and, for example, buttonholed by a buttonholing machine 31. A button sewing machine may then sew a button onto the cuff. The cuff may be fed to the sewing machine by a spring feeder (not shown) from a button feeder (not shown) accommodated, for example, in a housing 35.

Having described the aforementioned embodiment in which two delivery rollers are provided for taking the cuff out from under the stack, it should be understood that either one of the delivery rollers standing alone may also serve to this end.

The aforementioned embodiment has referred to the drive cylinder 13 for rotating the delivery rollers 8, 8' and the drive cylinders 14, 16 for pulling the slack of the inconstant-thickness workpiece. It is to be also understood, however, that the present invention is not limited to the use of air cylinders.

Figure 13:
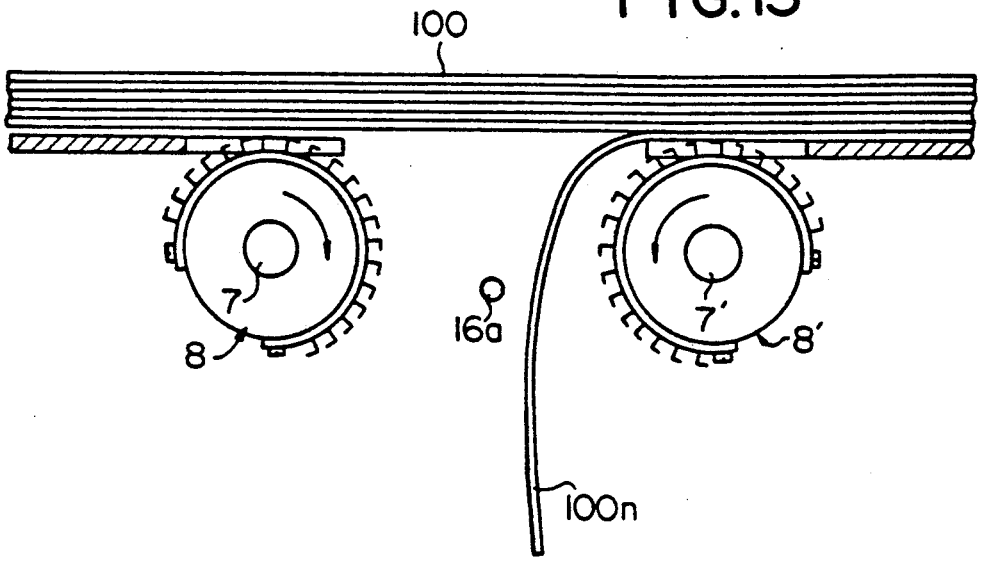
FIG. 13 is a view explanatory of a workpiece which is inadvertently off of one of the delivery rollers.

As stated above, the lowermost cuff 100*n* is pulled down by the piston rod 16*a* of the drive cylinder 16. In the instance that the lowermost cuff 100*n* happens to inadvertently disengage from the delivery roller 8, even if the drive cylinder 16 is lowered by the cylinder 14, one of the delivery rollers on one side of the lowermost cuff may become out of position, as shown in FIG. 13.

Figure 11:
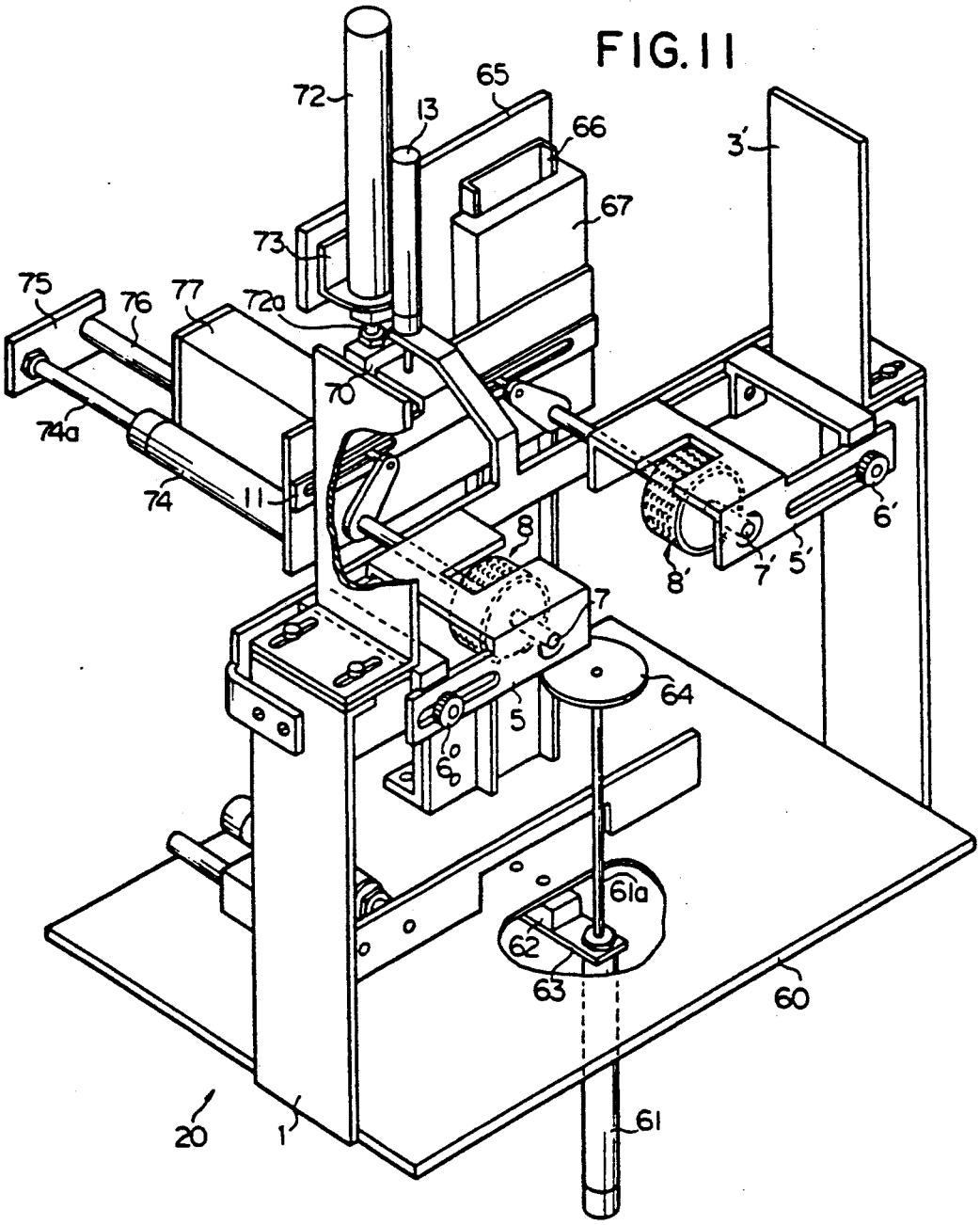
FIG. 11 and 12 are perspective views of another embodiment of the workpiece feeding apparatus according to the invention.
Figure 12:
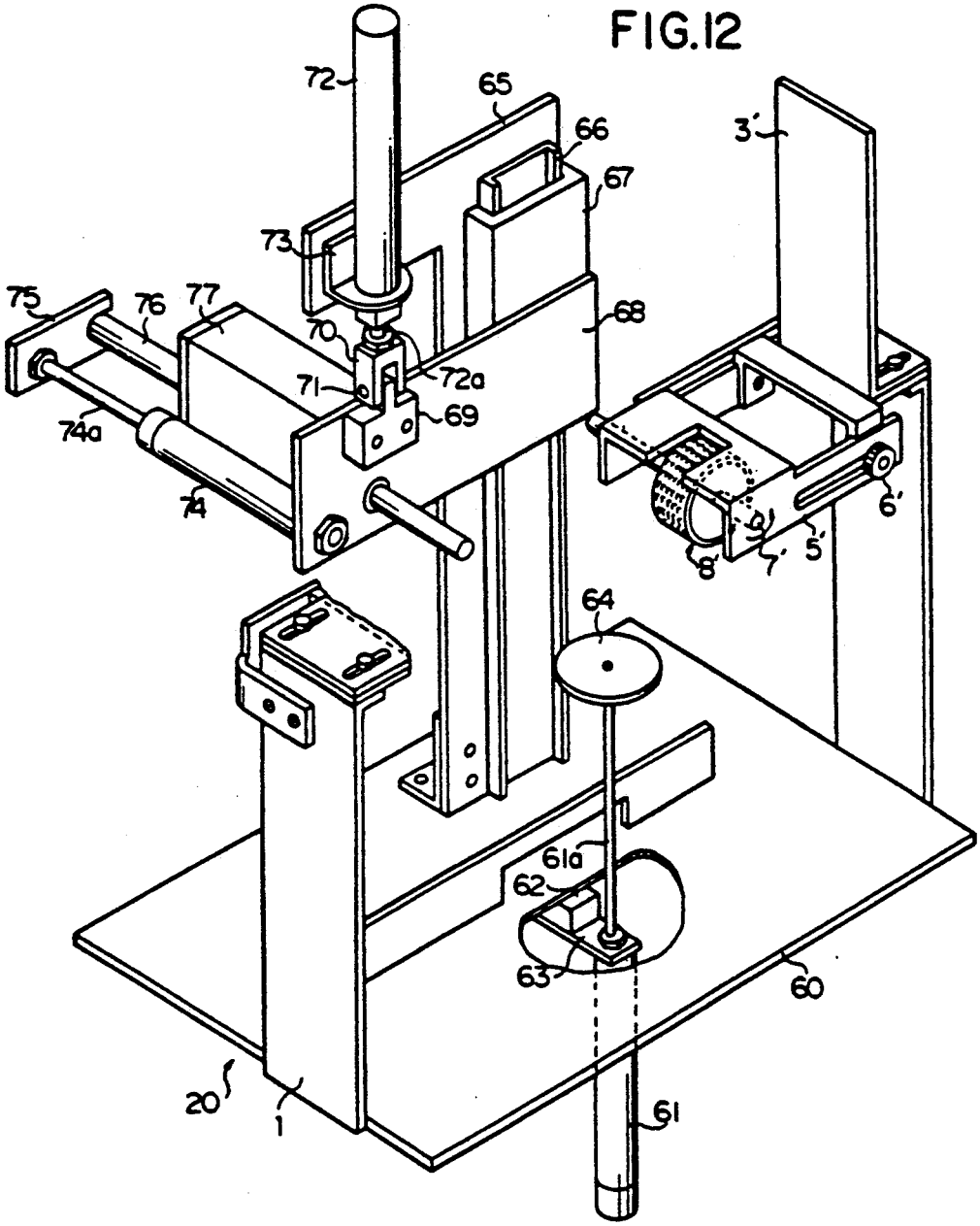

Referring now to FIGS. 11 and 12, wherein like reference numerals designate like or corresponding parts throughout the views, a cuff clamp cylinder 61 is mounted on a cylinder mounting plate 63 affixed to a cylinder block 62 under a base plate 60. A cuff clamp plate 64 in disc form is secured to the end of a piston rod 61*a* of the cuff clamp cylinder 61. A slide rail 66 is fixed to a rail mounting plate 65 secured upright to the back of the base plate 60 and includes a slide mounted thereon. A bracket 68 is affixed to the slide 67 and includes a joint block 69 attached to the top thereof. A knuckle joint 70 is connected by a joint pin 71 to the joint block 69 and is connected to a piston rod 72*a* of a cuff pickup cylinder 72 which is mounted by a support member 73 on the rail mounting plate 65. A cylinder 74 is attached to a bracket 68 and carries a piston rod 74*a* attached to a plate 75 to which one end of a shaft 76 is fixed. The shaft 76 passes through a guide 77 affixed to the bracket 68 and extends through the hole in the bracket 68 to the side of the clamp plate 64.

Figure 14:
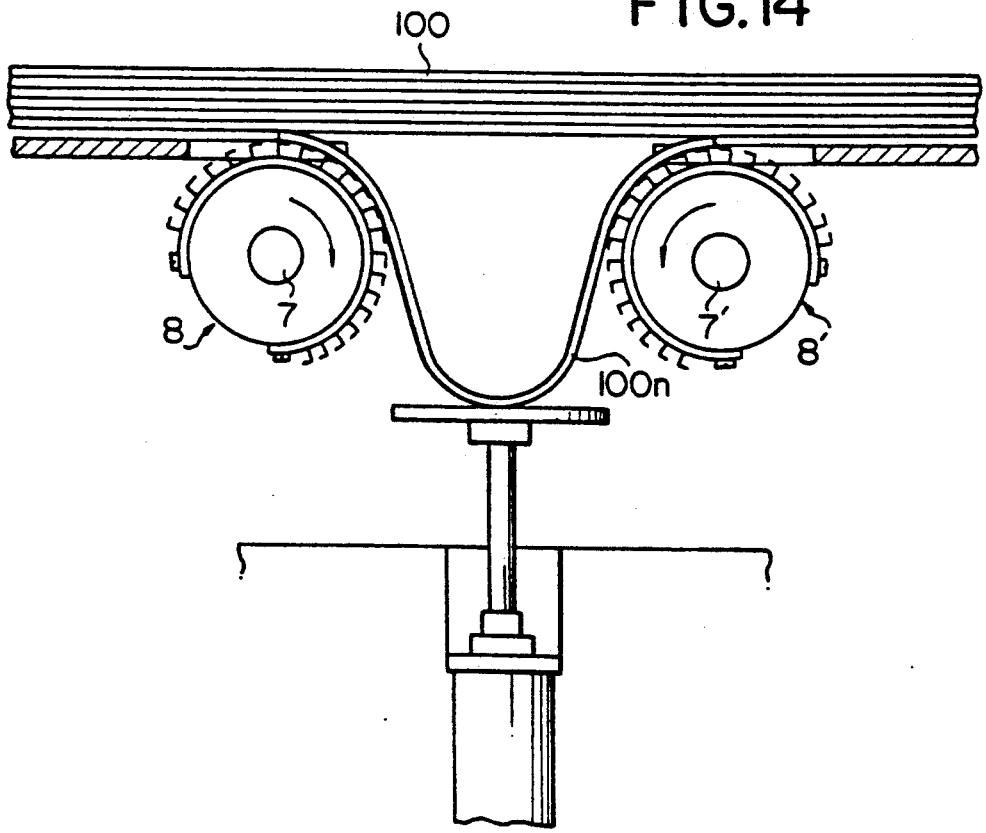
FIG. 14 is a representation explanatory of the advantages of the embodiments shown in FIGS. 11 and 12.

According to the embodiment as above designed, the lowermost workpiece cuff 100*n* is caused to form slack D by rotation of the delivery rollers 8, 8'. Then, shaft 76 is extended to the slack while cylinder 61 is driven to raise the piston rod 61*a* so that the cuff 100*n* is clamped, as shown in FIG. 14, by the shaft 76 and the clamp plate 64 disposed on the one end of the piston rod 61*a*. Then, the cylinder 61 is driven synchronously with the cuff pickup cylinder 72 to lower the bracket 68 and the cuff clamp plate 64. Subsequently, the cuff is pulled down while held by the shaft 74 and the clamp plate 64. This will ensure withdrawal of the cuff 100*n* even if either one of the delivery rollers 8, 8' is out of engagement.

Although the invention has been described in detail by way of reference to the disclosed embodiments, it should be understood that the invention is not limited to the disclosed embodiments, but should be interpreted only in accordance with the claims which follow.

What is claimed is:

1. An inconstant thickness workpiece feeding apparatus comprising:

(a) a support for supporting a workpiece stack, said support having an opening so that al lowermost workpiece in the stack is partially exposed, (b) roller means disposed at said opening to contact with the lowermost workpiece in the stack, (c) means for rotating said roller means to slacken said lowermost workpiece to form a space between said lowermost workpiece and said stack, (d) rod means adapted to insert into said space between said lowermost workpiece and said stack, (e) means for moving down said rod means to draw down said lowermost workpiece, and (f) a clamp plate under said opening of said support and means for moving said clamp plate to clamp said lowermost workpiece between said rod means and said clamp plate.

2. An inconstant thickness workpiece feeding apparatus according to claim 1, wherein said roller means comprises a pair of rollers and means for regulating a distance between the two rollers.

3. An inconstant thickness workpiece feeding apparatus according to claim 1, wherein said roller means comprises a plurality of needle-shape projections, each projection having a tip end bending in the direction of roller rotation.

4. An inconstant thickness workpiece feeding apparatus according to claim 1, wherein said means for rotating said roller means includes means for rotating a roller within a limited range of less than ninety degrees.

5. An inconstant thickness workpiece feeding apparatus comprising:

(a) a support for supporting a workpiece stack, said support having an opening so that a lowermost workpiece in the stack is partially exposed;

(b) a roller disposed at said opening contacts the lowermost workpiece in the stack;

(c) a first drive cylinder rotates said roller to slacken said lowermost workpiece to form a space between said lowermost workpiece and said stack;

(d) a second drive cylinder inserts a rod into said space between said lowermost workpiece and said stack;

(e) a third drive cylinder draws said rod and said lowermost workpiece downward; and (f) a clamp plate under said opening of said support and a cuff clamp cylinder to move said clamp plate to clamp said lowermost workpiece between said rod and said clamp plate.

6. A method for feeding an inconstant thickness workpiece comprising the following steps:

(a) rotating a roller to contact a lowermost workpiece in a workpiece stack, slackening said lowermost workpiece to form a space between said lowermost workpiece and said stack;

(b) inserting a rod into said space between said lowermost workpiece and said stack;

(c) moving said rod to draw down said lowermost workpiece;

(d) moving a clamp plate in a direction opposite and toward said rod; and (e) clamping said lowermost workpiece between said rod and said clamp plate.

* * * * *